US011832775B2

(12) United States Patent
Metzel

(10) Patent No.: US 11,832,775 B2
(45) Date of Patent: Dec. 5, 2023

(54) RINSE BUCKET FOR FLOOR MOP

(71) Applicant: Carl Freudenberg KG, Weinheim (DE)

(72) Inventor: Doug Metzel, Lombard, IL (US)

(73) Assignee: Carl Freudenberg KG, Weinheim (DE)

( * ) Notice: Subject to any disclaimer, the term of this patent is extended or adjusted under 35 U.S.C. 154(b) by 223 days.

(21) Appl. No.: 17/143,631

(22) Filed: Jan. 7, 2021

(65) Prior Publication Data

US 2022/0211242 A1 Jul. 7, 2022

(51) Int. Cl.
*A47L 13/59* (2006.01)

(52) U.S. Cl.
CPC ..... *A47L 13/59* (2013.01)

(58) Field of Classification Search
CPC ..... A47L 13/58; A47L 13/59
See application file for complete search history.

(56) References Cited

U.S. PATENT DOCUMENTS

| | | | |
|---|---|---|---|
| 5,743,282 | A | 4/1998 | Pellerin |
| 5,983,441 | A | 11/1999 | Williams et al. |
| 7,437,795 | B1 | 10/2008 | Bez |
| 2002/0116781 | A1 | 8/2002 | Williams et al. |
| 2004/0088781 | A1 | 5/2004 | Suffa |
| 2010/0095473 | A1 | 4/2010 | Azancot |
| 2012/0241389 | A1 | 9/2012 | Van Landingham, Jr. et al. |
| 2014/0263104 | A1 | 9/2014 | Kepner et al. |
| 2018/0279849 | A1* | 10/2018 | Dingert ..... A47L 13/58 |

FOREIGN PATENT DOCUMENTS

| | | | | |
|---|---|---|---|---|
| CN | 203 898 239 | U | 10/2014 | |
| CN | 204 744 056 | U | 11/2015 | |
| EP | 0781524 | A2 | 7/1997 | |
| EP | 1358832 | A1 | 11/2003 | |
| EP | 1685027 | B1 | 8/2012 | |
| EP | 3269286 | A2 | 1/2018 | |
| EP | 3541259 | B1 | 1/2022 | |
| ES | 1065318 | U | 7/2007 | |
| WO | WO 2006/094918 | A1 | 9/2006 | |
| WO | WO 2012/107609 | A1 | 8/2012 | |
| WO | WO-2015114300 | A1 * | 8/2015 | ..... A47J 47/18 |
| WO | WO-2015124917 | A1 * | 8/2015 | ..... A47L 13/58 |
| WO | WO 2018091357 | A2 | 5/2018 | |
| WO | WO 2019/025645 | A1 | 2/2019 | |

OTHER PUBLICATIONS

Translation of Wo2012107609A1, retrieved from Google patents on Dec. 23, 2022 (Year: 2012).*
Polígono Industrial Alcalde Caballero, "Embell System," product brochure, 6 pp.

* cited by examiner

*Primary Examiner* — Tom Rodgers
(74) *Attorney, Agent, or Firm* — Leydig, Voit & Mayer, Ltd.

(57) ABSTRACT

A bucket assembly for use with a mop includes inner and outer bucket assemblies including first and second reservoirs, respectively. The inner bucket assembly includes a rinse bucket, fluid connection and closure element between the rinse bucket and the first reservoir. The first reservoir is optionally otherwise sealed when the at least one closure element is in the open position. The inner bucket is disposed at least partially within the second reservoir. A drainage channel fluidly connected to the second reservoir is formed by at least one of the inner bucket assembly and/or the outer bucket assembly.

21 Claims, 11 Drawing Sheets

RINSE BUCKET FOR FLOOR MOP

TECHNICAL FIELD

This patent disclosure relates generally to buckets and, more particularly to buckets for rinsing cleaning devices such as mops.

BACKGROUND

Floor mops are often used in conjunction with a bucket containing rinsing fluid, such as water and/or cleaning fluid for replenishing moisture on the mop head or rinsing the mop head. After applying the mop head to a surface to be cleaned, however, placement of the mop head back into the rinsing fluid provides a contamination with dirt removed from the cleaned surface. Repeated insertions in the rinsing fluid and usage on a surface to be cleaned enhances the level of dirt in the rinsing fluid, and may diminish the ability of the system to clean a surface. Emptying of the bucket to obtain clean rinsing fluid atmosphere may be inconvenient and time consuming. Emptying of the bucket to obtain clean rinsing fluid additionally increases water consumption, and may increase cleaning fluid consumption.

The Embell System is a bucket system that provides a bucket having two separate chambers for receiving the mop head. A rinsing fluid valve is actuated to measure out a predetermined amount of rinsing fluid into a first chamber for each rinse of the mop head. After the mop head is rinsed in the first chamber, the rinsed mop head is placed into a second chamber where the mop head is squeezed to dry the mop head before it is applied to a subsequent surface. Squeezing the mop head separates excess rinsing water from the mop head, the extracted rinsing water automatically draining into a dirty water tank. As the mop head is squeezed in the second chamber, the force likewise is applied to open a drain in the first chamber to discard any remaining rinsing fluid in the first chamber. As the mop head is removed from the second chamber, the operator may use the mop handle to actuate the clean water valve adjacent the second chamber to again measure a predetermined amount of rinsing water into the first chamber.

SUMMARY

The disclosure describes, in one aspect, a bucket assembly for use with a mop having a mop head. The bucket assembly includes an inner bucket assembly and an outer bucket assembly. The inner bucket assembly includes a rinse bucket, a first reservoir, a fluid connection between the rinse bucket and the first reservoir, and at least one closure element disposed at the fluid connection and movable between an open position and a closed position. The inner bucket may include a fill hole and a plug. The first reservoir is optionally otherwise sealed when the at least one closure element is in the open position. The outer bucket assembly includes an outer bucket peripheral wall extending from an outer bucket base to form a second reservoir. The inner bucket is disposed at least partially within the second reservoir. A drainage channel is fluidly connected to the second reservoir. The drainage channel formed by at least one of the inner bucket assembly, the outer bucket assembly, and the inner bucket assembly and the outer bucket assembly.

The disclosure describes in another aspect, a bucket assembly for use with a mop having a mop head, the bucket assembly including an inner bucket assembly and an outer bucket assembly having first and second reservoirs. The outer bucket assembly includes an outer bucket peripheral wall extending from an outer bucket base to form the second reservoir, the inner bucket being disposed at least partially within the second reservoir. The inner bucket assembly includes a first inner bucket element and a second inner bucket element. The first inner bucket element forms a rinse bucket, and the first reservoir is formed between the first inner bucket element and the second inner bucket element. A fluid connection is disposed between the rinse bucket and the first reservoir, and at least one closure element is disposed at the fluid connection and movable between an open position and a closed position. A drainage channel is at least partially formed by the inner bucket assembly, and is fluidly connected to the second reservoir. A plurality of welds is provided between the first inner bucket element and the second inner bucket element including a first weld between the first circumferentially about the rinse bucket, a second weld circumferentially about the drainage channel, and a third weld about peripheries of both the first inner bucket element and the second inner bucket element.

BRIEF DESCRIPTION OF THE DRAWING(S)

DETAILED DESCRIPTION

Figure 1:
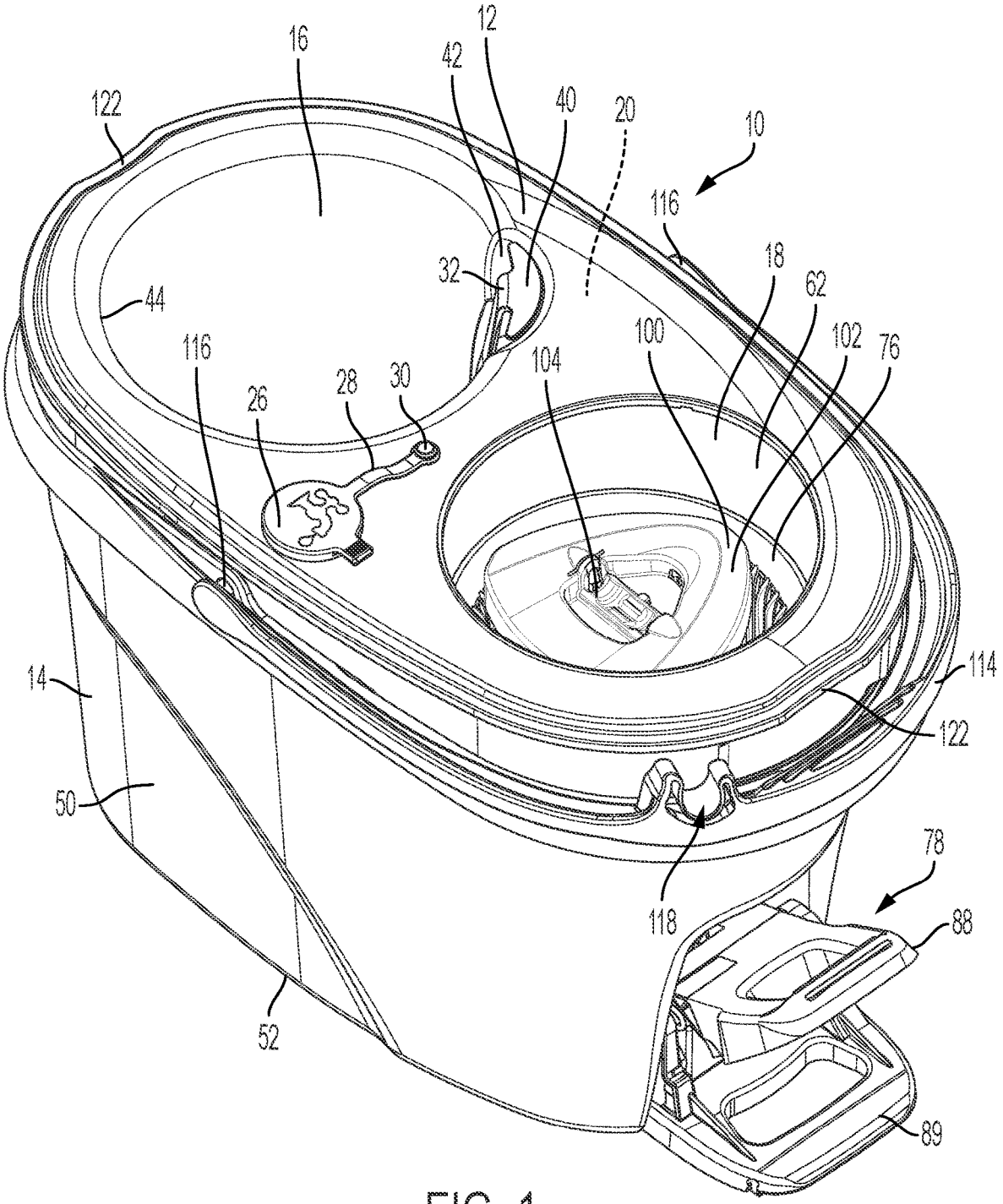
FIG. 1 is an isometric view of the top and front of a bucket assembly and exemplary fragmentary mop head according to aspects of this disclosure.

This disclosure relates to a bucket assembly 10 for use with a mop. While the mop is not specifically illustrated, those of skill in the art will appreciate that the mop would have a shaft and a mop head that typically includes one or more absorbent structures. An exemplary interior of a representative mop head 100 is illustrated in the figures as a generally triangular structure, explained in greater detail below. Referring to the embodiment of the bucket assembly 10 illustrated in FIG. 1, the exploded view of FIG. 2, and the cross-sectional views of FIGS. 3A and 3B, the bucket assembly 10 includes an inner bucket assembly 12 received at partially in an outer bucket assembly 14, and presents a rinse bucket 16 for rinsing a mop head, and a drainage channel 18 for receiving excess fluid from the mop head.

The inner bucket assembly 12 includes the rinse bucket 16, as well as a first reservoir 20 that is fluid couplable to the rinse bucket 16 by a fluid connection 22. The inner bucket assembly 12 may also include a fill opening 24 that opens into the first reservoir 20, and a plug 26 sized to seal the fill opening 24. While an alternative design may be provided, in the illustrated embodiment, the plug 26 is coupled with the inner bucket assembly 12 by way of an arm 28 the may be coupled to the inner bucket assembly 12 by way of an engaging structure such as a rivet 30 or the like. The first reservoir 20 may be utilized to hold a rinse fluid for provision to the rinse bucket 16 so that a mop head may be placed in the rinse bucket 16 for contact with the rinse fluid. The rinse fluid may be any appropriate fluid, such as water, water with a cleaning solution, or another cleaning solution.

The fluid connection 22 may be selectively opened and closed by way of at least one closure element 32. While an alternative arrangement may be provided, in the illustrated embodiment, the closure element 32 is an elongated structure 34 that is slidably received in an elongated recess 36 that is flanked on either side by flanges 38. In order to facilitate movement by an operator, the closure element 32 includes a handle or tab 40 at its upper end. The inner bucket assembly 12 may likewise include a depression or recess 42 disposed substantially adjacent the tab 40 in assembly. The recess 42 may allow an operator to easily grasp the tab 40 and slide the elongated structure 34 of the closure element 32 within the elongated recess 36 in order to selectively open and close the fluid connection 22.

Figure 3A:
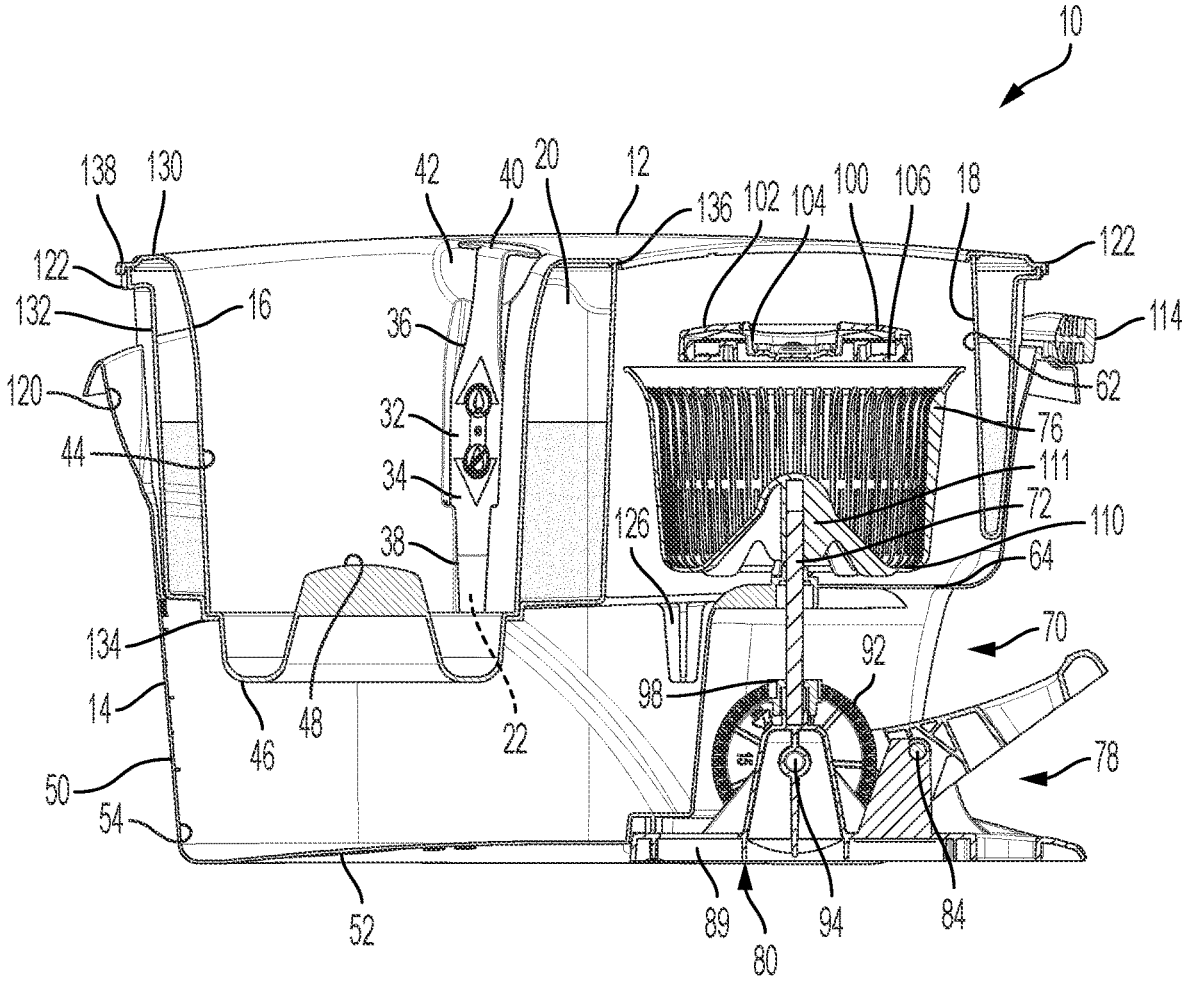
FIG. 3A is a cross-sectional view of the bucket assembly and exemplary fragmentary mop head of FIG. 1 with the closure element between the first reservoir and the rinse bucket in a closed position.
Figure 3B:
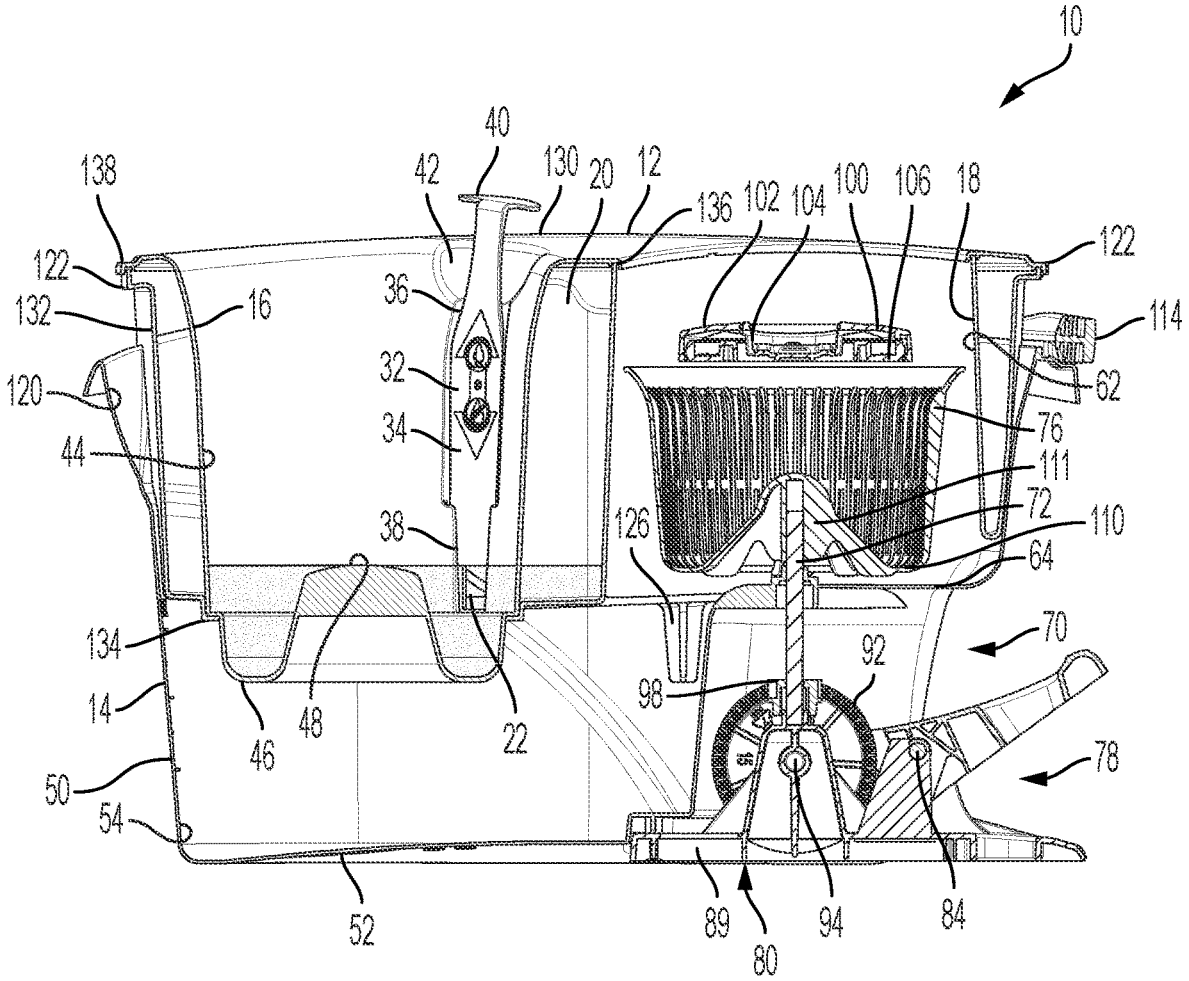
FIG. 3B is a cross-sectional view of the bucket assembly and exemplary fragmentary mop head of FIG. 1 with the closure element between the first reservoir and the rinse bucket in a closed position.

In order to allow flow from the first reservoir 20 to the rinse bucket 16, the closure element 32 may be moved from the closed position illustrated in FIG. 3A, to the open position illustrated in FIG. 3B. As the closure element 32 moves from the closed position (FIG. 3A) to the open position (FIG. 3B), the fluid connection 22 between the first reservoir 20 and the rinse bucket 16 is progressively opened. Conversely, as the closure element 32 moves from the open position to the closed position, the fluid connection 22 between the first reservoir 20 and the rinse bucket 16 is progressively closed.

The inner bucket assembly 12 may further include one or more detents or other mechanisms by which may facilitate retention of the closure element 32 in a particular position relative to the fluid connection 22 and the elongated recess 36. For example, a number of protrusions and/or recesses may be provided along the closure element 32 and the rinse bucket 16. The engagement of the protrusions with the recesses, as well as other surfaces may provide detents that facilitate maintenance of the closure element 32 in a particular position.

Referring to FIGS. 4-7, in at least one embodiment, the closure element 32 may include one or more protrusions 152, 154, 156 and recesses 164, and the rinse bucket 16 may include one or more protrusions 160 and recesses 162. More specifically, protrusion 152 may be located along the closure element 32 such that it abuts an edge of the fluid connection 22 when the closure element 32 is disposed in a closed position (see FIGS. 3A, 5 and 7). In this way, the disposition of the protrusion 152 against the edge of the fluid connection 22 as well as the distal end of the closure element 32 abutting a surface of the rinse bucket 16 acts to retain the closure element 32 in the closed position, inhibiting flow through the fluid connection 22.

Figure 5:
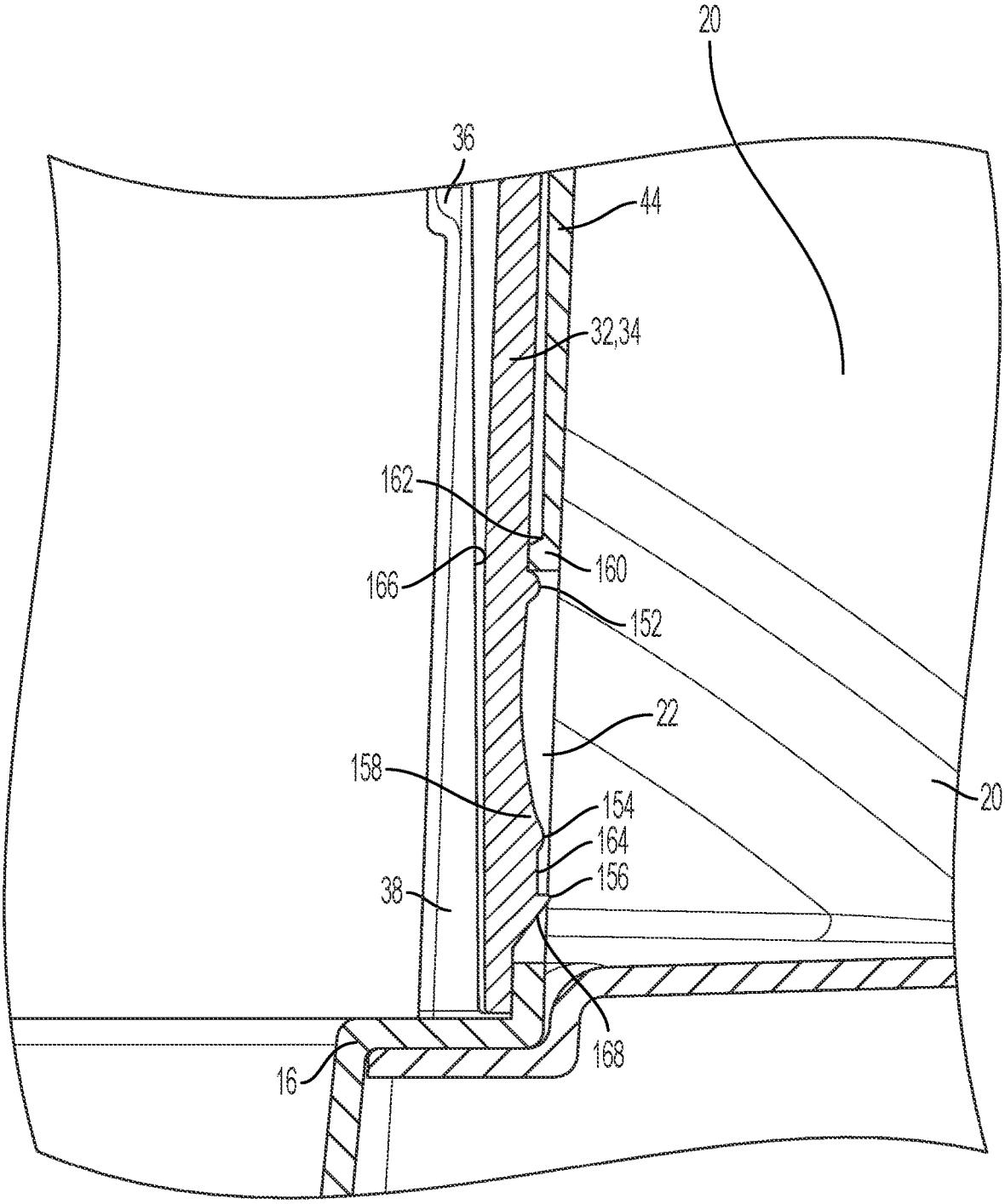
FIG. 5 is an enlarged, fragmentary, cross-sectional view of an embodiment of a closure element and a rinse bucket according to teachings of this disclosure and wherein the closure element is in a closed position relative to a fluid connection.
Figure 6:
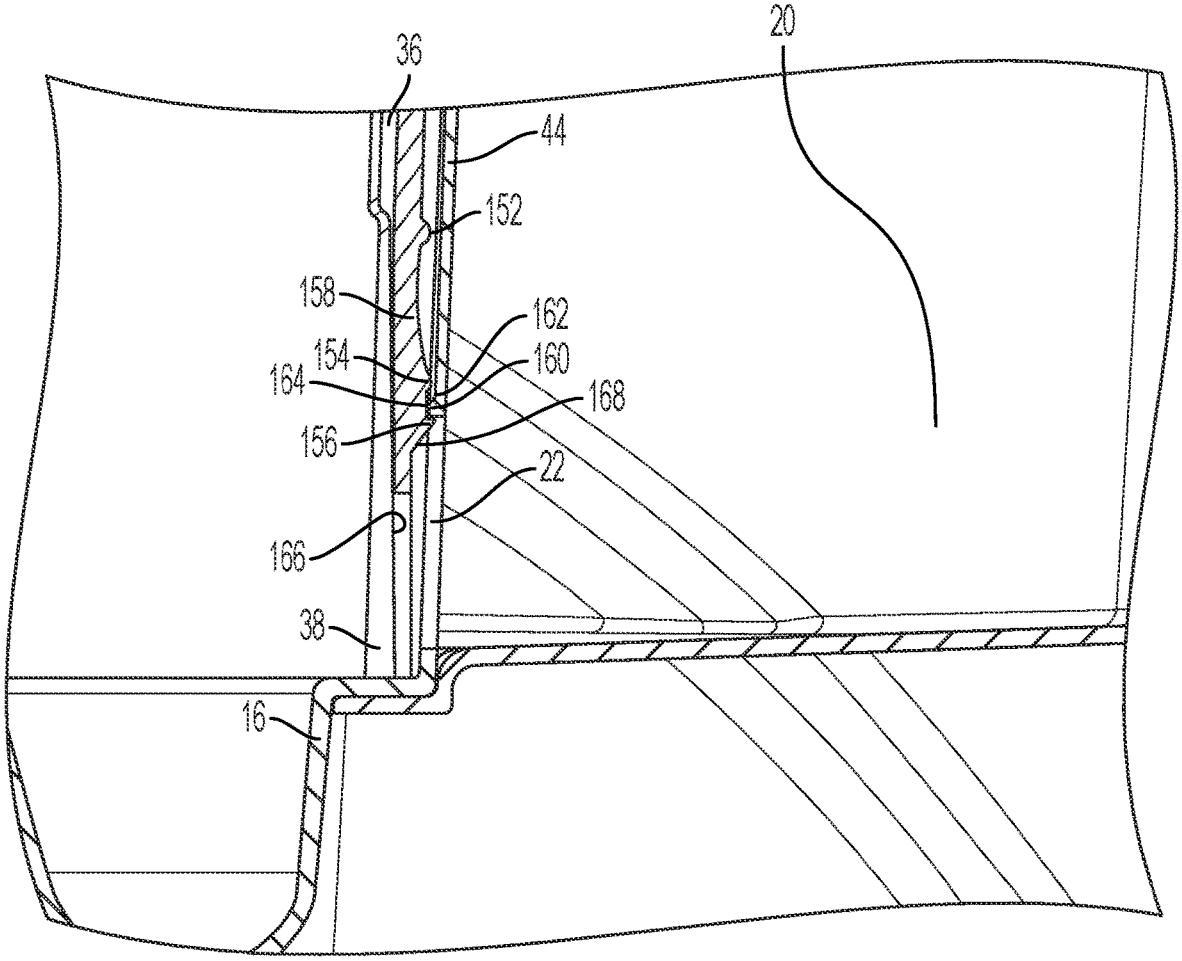
FIG. 6 is an enlarged, fragmentary, cross-sectional view of the closure element and rinse bucket of FIG. 5 wherein the closure element is in an open position relative to a fluid connection.

According to another aspect of the illustrated embodiment, a protrusion 160 may be formed in the rinse bucket 16, while the closure element 32 may include protrusions 154, 156 forming recess 164 therebetween. While the protrusion 160 of the rinse bucket 16 is disposed proximal to an edge of the fluid connection 22 in the embodiment as illustrated in FIGS. 5 and 6, protrusion may alternatively be spaced away from the edge. As illustrated in FIG. 6, when the closure element 32 is disposed in the open position, the protrusions 154, 156 of the closure element 32 are disposed about the protrusion 160 of the rinse bucket 16. That is, the protrusion 160 of the rinse bucket 16 is disposed within the recess 164 formed between the protrusions 154, 156 of the closure element 32 to facilitate retention of the closure element 32 in the open position relative to the fluid connection 22.

Figure 7:
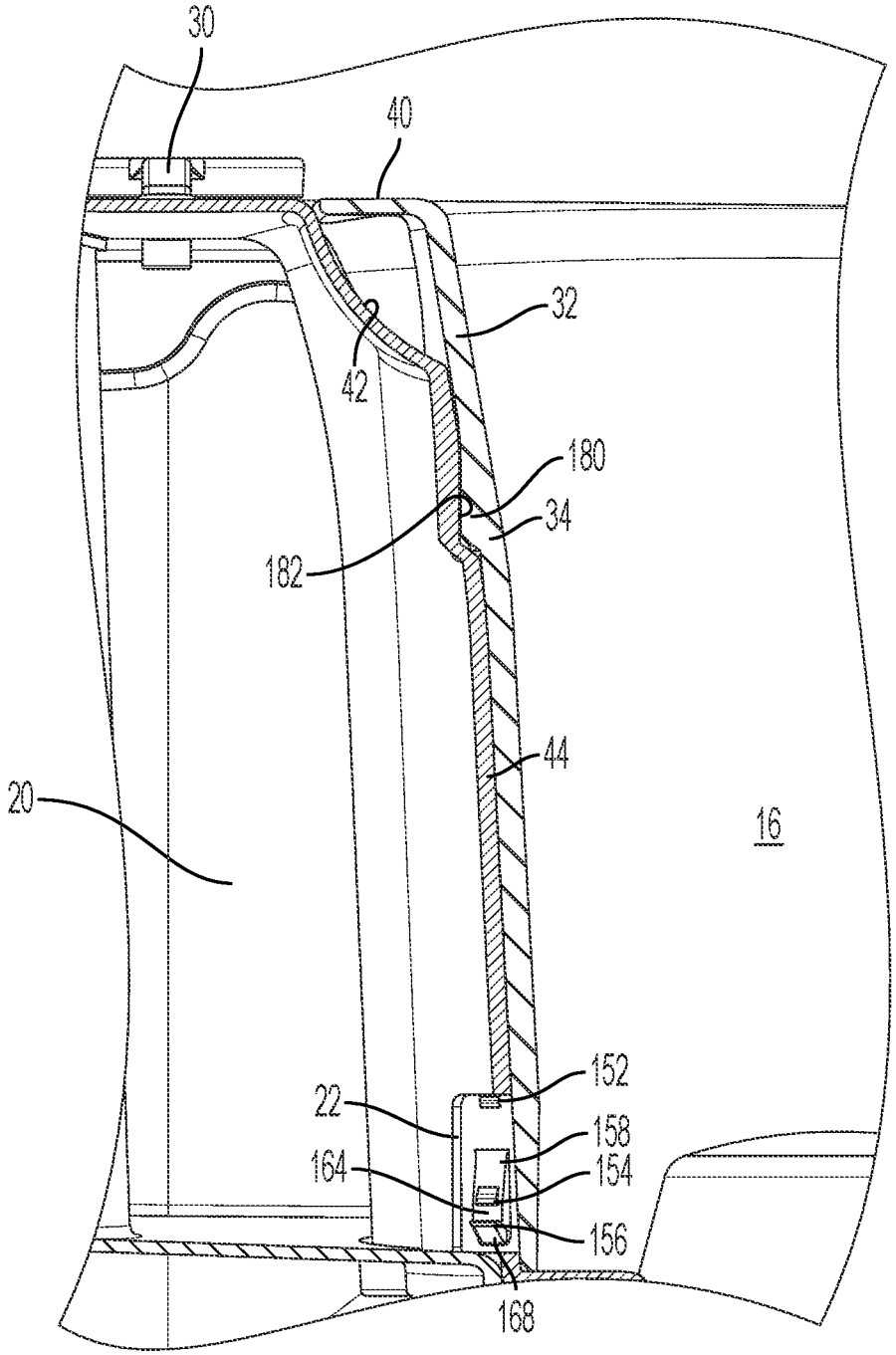
FIG. 7 is an enlarged, fragmentary, cross-sectional view of the closure element and rinse bucket wherein the closure element is in a closed position relative to a fluid connection, as in FIG. 5.

In order to enhance the engagement of the positional detents, one or more biasing elements may be provided. That is, such biasing elements may be provided to facilitate the engagement of the protrusion 152 of the closure element 32 abutting an edge of the fluid connection 22 when the closure element 32 is disposed in a closed position, and/or the engagement of the protrusion 160 of the rinse bucket 16 within the recess 164 formed between the protrusions 154, 156 of the closure element 32. While alternative biasing elements such as, for example, springs may be provided, in the illustrated embodiment, the biasing elements are in the form of one or more ramped surfaces 158, 166. As may be seen in FIGS. 5 and 6, the flanges 38 on either side of the elongated recess 36 in which the closure element 32 is slidably disposed may include a ramp 166. In this way, as the closure element 32 moves from the open position to the closed position, the ramp 166 biases the distal end of the closure element 32 toward the fluid connection 22 through the rinse bucket peripheral wall 44, causing the protrusion 152 to be disposed within the fluid connection 22. As shown in FIGS. 5 and 7, the protrusion 152 is disposed abutting the edge of the fluid connection 22 and the protrusion 160 of the rinse bucket peripheral wall 44 to bias the closure element 32 into the closed position.

Figure 4:
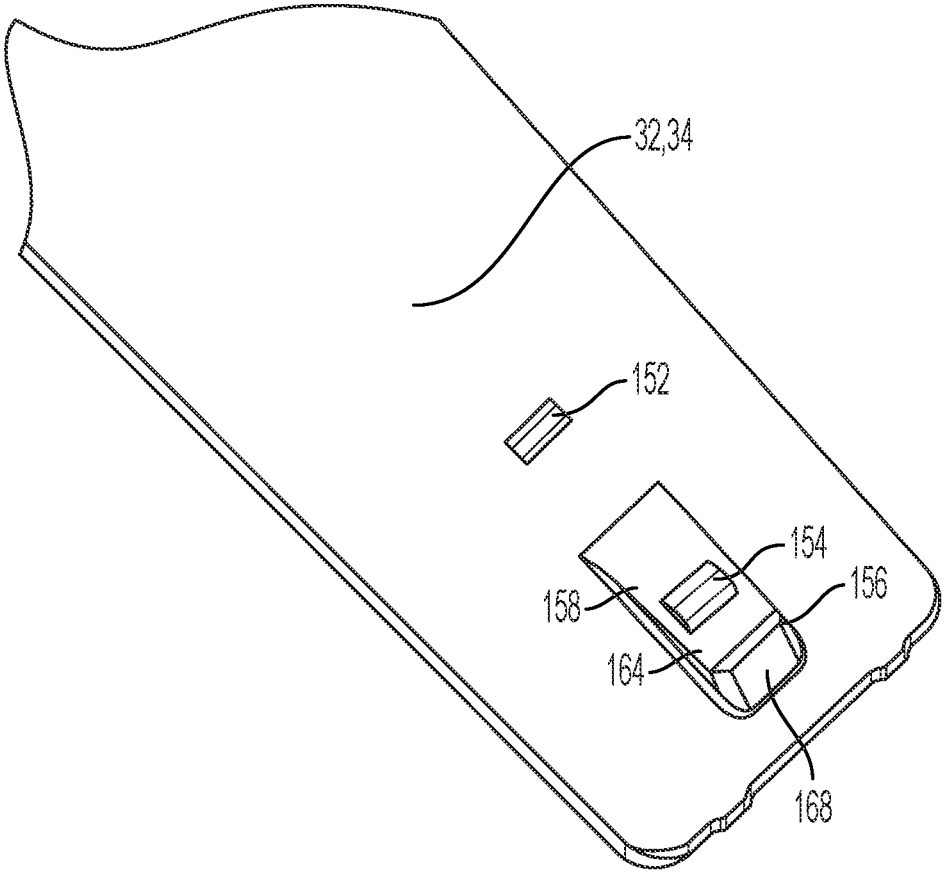
FIG. 4 is an enlarged, fragmentary, isometric view of an end of an embodiment of the closure element of FIGS. 1-3B.

As may be seen in FIGS. 4-6, the closure element 32 may alternatively or additionally include a ramped surface. In the illustrated embodiment, the protrusions 154, 156 are disposed along a ramped surface 158 of the closure element 32. While the ramped surface 158 extends partially across the lateral face of the closure element 32, it will be appreciated that the ramped surface 158 may alternatively extend across a greater portion of the lateral face of the closure element 32. As the closure element 32 is advanced from the closed position illustrated in FIG. 5 to the closed position illustrated in FIG. 6, the protrusion 160 of the rinse bucket peripheral wall 44 rides along the ramped surface 158. In this way, with a slight force, the protrusion 154 may be moved over the protrusion 160, allowing the protrusion 160 to be positioned in the recess 164 between the protrusions 154, 156. It will be appreciated that the protrusion 156 may include a distal ramped surface 168 that may facilitate initial assembly of the closure element 32 in the elongated recess 36.

While the illustrated embodiment includes a plurality of protrusions and recesses are located in exemplary positions on the closure element 32 and the peripheral wall 44, those of skill in the art will appreciate that one or more such detents may alternatively be located to define detent position. Alternatively, or additionally, separate structures may be provided.

It will also be appreciated that additional guidance structures may be provided. By way of example only, an end of the closure element 32 proximal the handle or tab 40 and the adjacent rinse bucket peripheral wall 44 may be provided with a keyed structure. In the illustrated embodiment of FIG. 7, the closure element 32 is provided with a protruding key 180, while the elongated recess 36 within the rinse bucket peripheral wall 44 may include an elongated slot 182. In this way, the protruding key 180 may slide within the elongated slot 182, guiding the movement of the closure element 32 within the elongated recess 36. Alternative arrangements for guiding the movement of the closure element 32 within the elongated recess 36 are envisioned by this disclosure. For example, the protruding key 180 and elongated slot 182 or other guiding structure may be alternatively placed, and/or the elongated recess 36 may include a protruding key, and the closure element 32 include an elongated slot receiving protruding key. Further the protruding key 180 may include a bulbous structure and the elongated slot 182 and engaging structure such that the protruding key 180 may slide longitudinally within the elongated slot 182, but lateral movement of the closure element 32 as well as movement of the closure element 32 at a right angle to the elongated slot 182 and elongated recess 36 are inhibited.

Those of skill in the art will appreciate that, while the at least one closure element 32 is illustrated as a sliding structure, the closure element may have an alternative structure. By way of example only, the closure element may be a pivoting element or a rotating element. The closure element may be movable to open the fluid connection 22 to varying degrees to allow, for example, varied levels of rinse fluid within the rinse bucket 16.

According to an aspect of this disclosure, the first reservoir 20 may be sealed chamber such that movement of the closure element 32 to the open position allow air into the first reservoir 20 to permit a flow of rinse fluid into the rinse bucket 16 through the fluid connection 22. In this way, the position of the fluid connection 22 within the rinse bucket 16, as well as the degree to which the closure element 32 is opened will dictate the level to which the rinse fluid will rise within the rinse bucket 16. Those of skill in the art will appreciate that the rinse fluid will enter the rinse bucket 16 only to the level to which the fluid connection 22 is opened. As a result, when the fluid connection 22 is maintained in an open position, clean rinse fluid will flow into the rinse bucket 16 each time the rinse fluid level in the rinse bucket 16 falls below the level to which the fluid connection 22 is opened. This automatic replenishment of the rinse fluid within the rinse bucket 16 may allow an operator more quickly and efficiently mop a surface.

The rinse bucket 16 may be of any appropriate shape and design. In the illustrated embodiment, the rinse bucket 16 includes a rinse bucket peripheral wall 44 extending from a rinse bucket base 46. The rinse bucket base 46 may include one or more protrusions 48 into the interior of the rinse bucket 16. The one or more protrusions 48 may be used as a base against which a pressure may be applied to the mop head during rinsing. Alternative designs are envisioned. While not illustrated, for example, those of skill in the art will appreciate that the rinse bucket 16 may be provided actuable drain holes. For example, depression of a spring-loaded center protrusion (not illustrated) may be used to open drain holes in the rinse bucket base 46 to allow selective drainage from the rinse bucket 16.

It will be appreciated that rinse fluid applied to the mop head in the rinse bucket 16 may be used in cleaning dirt and undesirable matter (collectively referred to as "dirt") from the mop head. The outer bucket assembly 14 includes an outer bucket peripheral wall 50 that extends from an outer bucket base 52 to form a second reservoir 54 for collection of rinse fluid and dirt from the mop head. In order to separate excess rinse fluid with dirt from the mop head, the drainage channel 18 that drains to a second reservoir 54 in the outer bucket assembly 14 is provided. While the drainage channel 18 may be formed by either the inner bucket assembly 12 or the outer bucket assembly 14, in the illustrated embodiment, the drainage channel 18 is formed by a combination of the inner and outer bucket assemblies 12, 14. That is, the inner bucket assembly 12 includes a first, tubular portion 62 of the drainage channel 18, with the outer bucket assembly 14 forming a partial bottom surface 64 of the drainage channel 18, a passage 66 between the inner and outer bucket assemblies 12, 14, allowing the flow of expelled fluid to the second reservoir 54. Thus, the separation of the drainage channel 18 from the outer bucket base 52 allows expelled fluid to flow to the second reservoir 54.

In order to facilitate expulsion of fluid from the mop head within the drainage channel 18, a wringer assembly 70 may be provided (see also FIGS. and 9). While an alternative arrangement may be utilized, in the illustrated embodiment, the wringer assembly 70 includes a rotating element 72 that extends into the drainage channel 18 and disposed to rotate a mop head disposed within the drainage channel 18, the rotating element 72 defining a central spin axis 74. While the rotating element 72 may directly engage the mop head in some designs, a cage or basket 76 may be engaged with the rotating element 72 and at least partially disposed within the drainage channel 18. In this way, rotation of the rotating element 72 and the basket 76 will rotate a received mop head to expel fluid outwards into the drainage channel 18 and/or the second reservoir 54.

In order to provide selective rotation to the rotating element 72, an actuating assembly 78 may be provided. As shown in FIGS. 3A and 3B, the rotating element 72 may extend through the outer bucket assembly 14 and into the drainage channel 18, allowing the actuating assembly 78 to be disposed outside of the outer bucket assembly 14. The actuating assembly 78 may include a gear assembly 80 and an arm 82 pivotably disposed to engage the gear assembly 80 and pivotably mounted relative to axis 84. One end of the arm 82 includes teeth 86, while the opposite end of the arm 82 acts as a foot pedal 88 for depression by the operator's foot to actuate the gear assembly 80 and rotate the rotating element 72, and basket 76, if provided. That is, the arm 82 and foot pedal 88 are pivotably coupled to a wringer assembly base 89 at axis 84. The wringer assembly base 89 may be coupled with the outer bucket assembly 14 with the rotating element 72 extending into the interior of the outer bucket assembly 14. An appropriate seal may be provided between the rotating element 72 and the outer bucket assembly 14.

Figure 8:
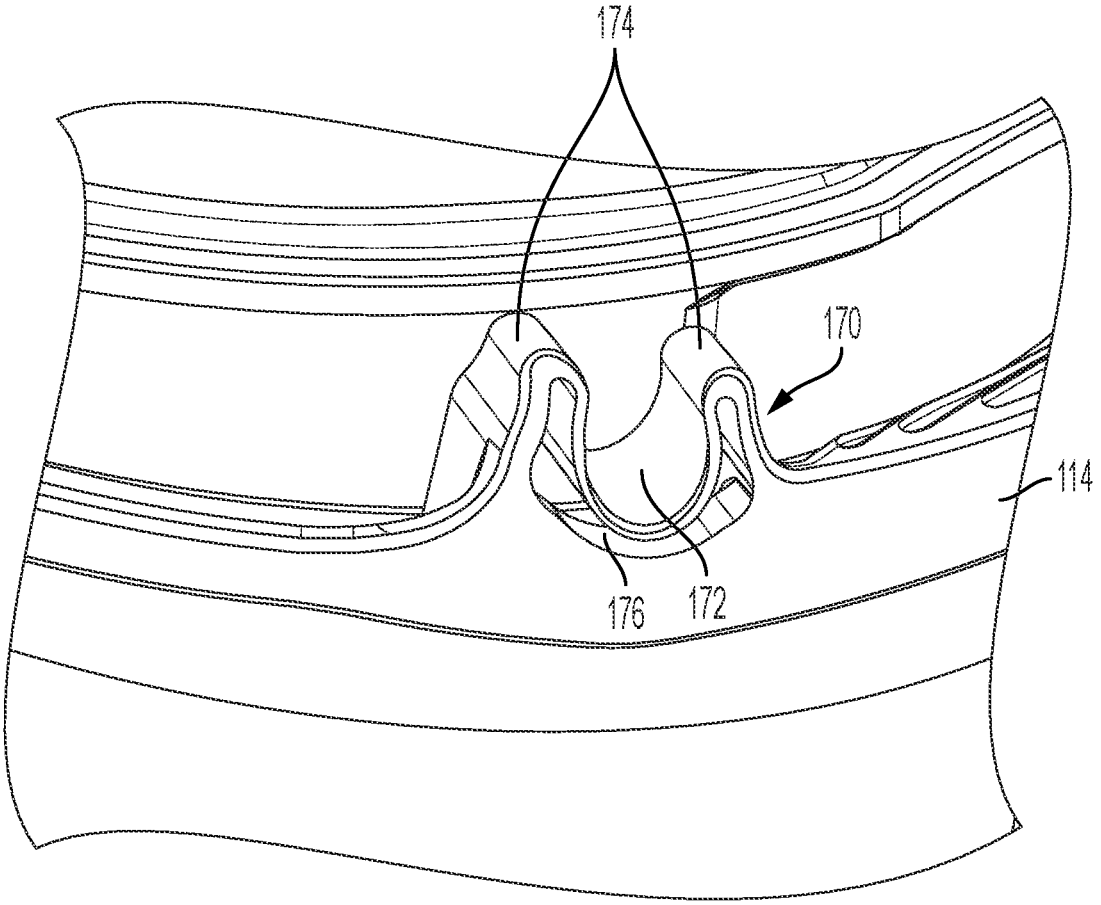
FIG. 8 is an isometric view of a wringer assembly of the bucket assembly according to an optional feature of the mop bucket assembly of FIGS. 1-3B.
Figure 9:
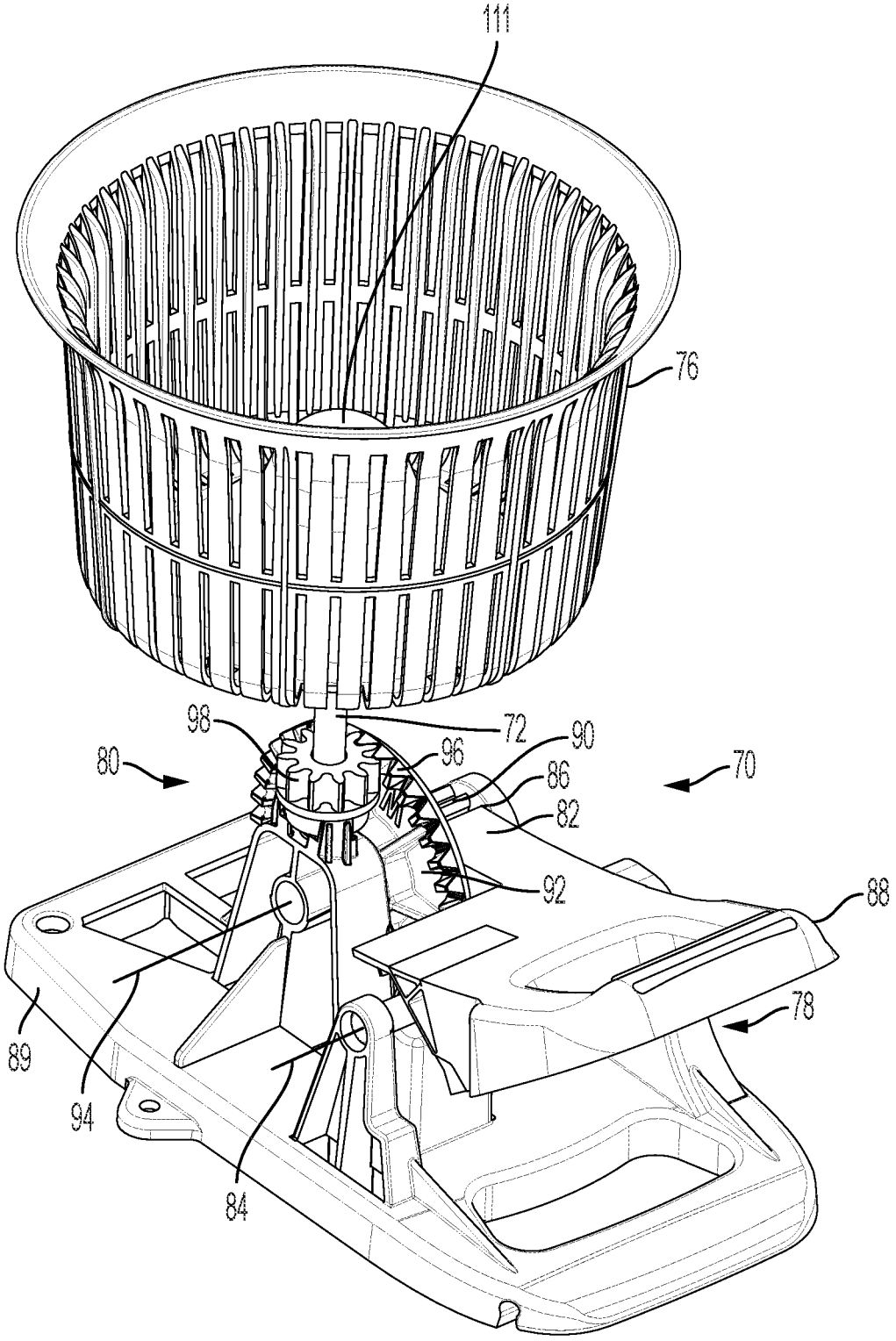
FIG. 9 is an isometric fragmentary view of the wringer assembly of FIG. 8.
Figure 10:
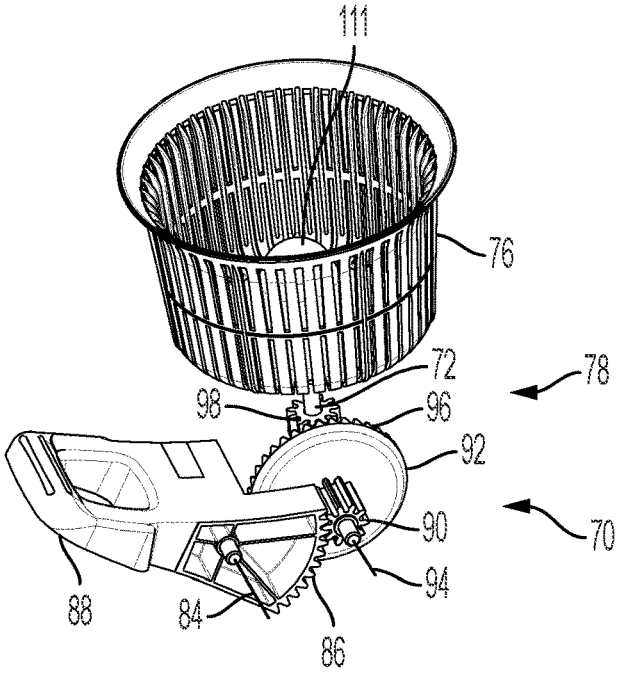
FIG. 10 is an enlarged, fragmentary, isometric view of an embodiment of a clip for a receiving a mop handle according to teachings of this disclosure.

As may be seen in FIGS. 8 and 9, the teeth 86 of the arm 82 are engaged with pinion gear 90, which is secured with gear 92 along axis 94. Gear 92 includes axially oriented teeth 96, which are rotatably engaged with pinion gear 98.

Pinion gear 98 is secured with the rotating element 72, such that depression of the foot pedal 88 causes a rotation of the rotating element 72.

An exemplary fragment of a mop head 100 is illustrated in FIGS. 1, 2, 3A and 3B. In this exemplary embodiment, a mop shaft (not illustrated may be attached to a mop head base 102 at a coupling element 104, or other appropriate structure. A fibrous mop portion (not illustrated) may be attached between a mop head base 102 and a retaining element 106. In this embodiment, the mop head 100 has a generally triangular structure, and may include a recess 108 formed, for example, by the retaining element 106.

As may be seen in FIGS. 3A and 3B, the cage or basket 76 may include a basket base 110 having a domed structure 111 extending into the interior of the basket 76, the rotating element 72 being received in the domed structure 111 of the basket base 110. In an arrangement where the mop head 100 illustrated in FIGS. 1, 2, 3A, and 3B, the domed structure of the basket base 110 may be at least partially received within the recess 108. In this way, rotation of the basket 76 causes a rotation of the mop head 100.

Figure 11:
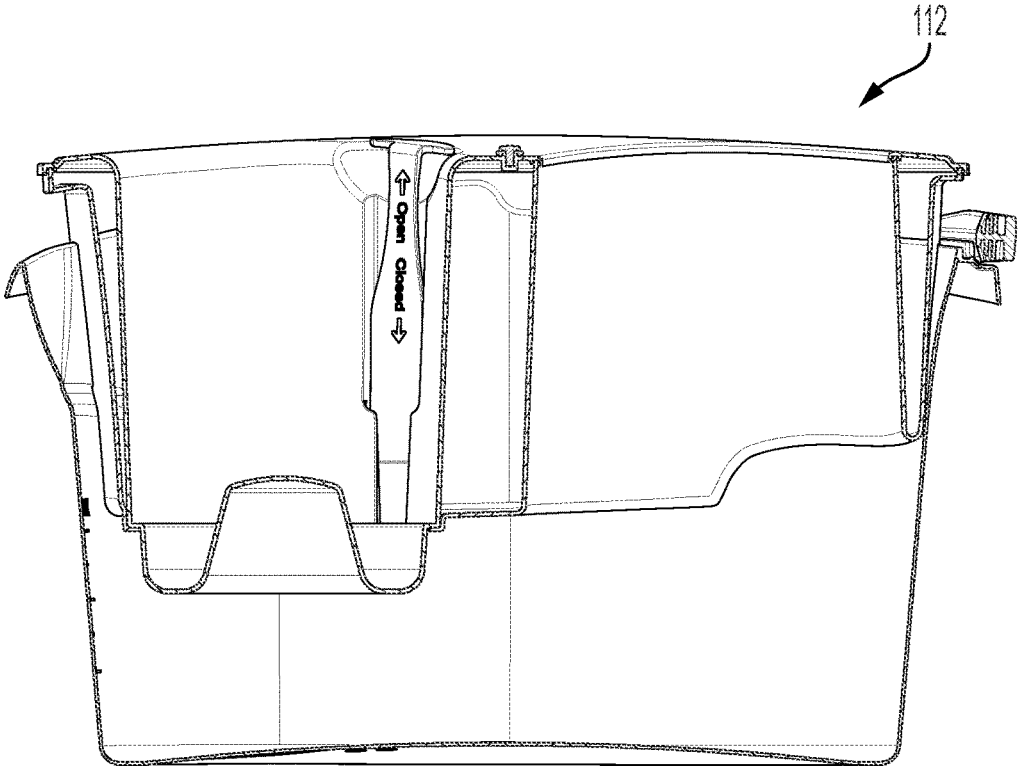
FIG. 11 is a cross-sectional view of an alternative embodiment of a bucket assembly according to aspects of this disclosure.

While the embodiment of FIGS. 1-3B and 8-9 includes a wringer assembly 70, those of skill in the art will appreciate that a bucket assembly may alternatively include a cage or basket of an alternatively design, or a cage or basket that does not rotate. In yet another embodiment, the bucket assembly 112 may include no cage or basket, such as is illustrated in FIG. 11, for example.

Figure 2:
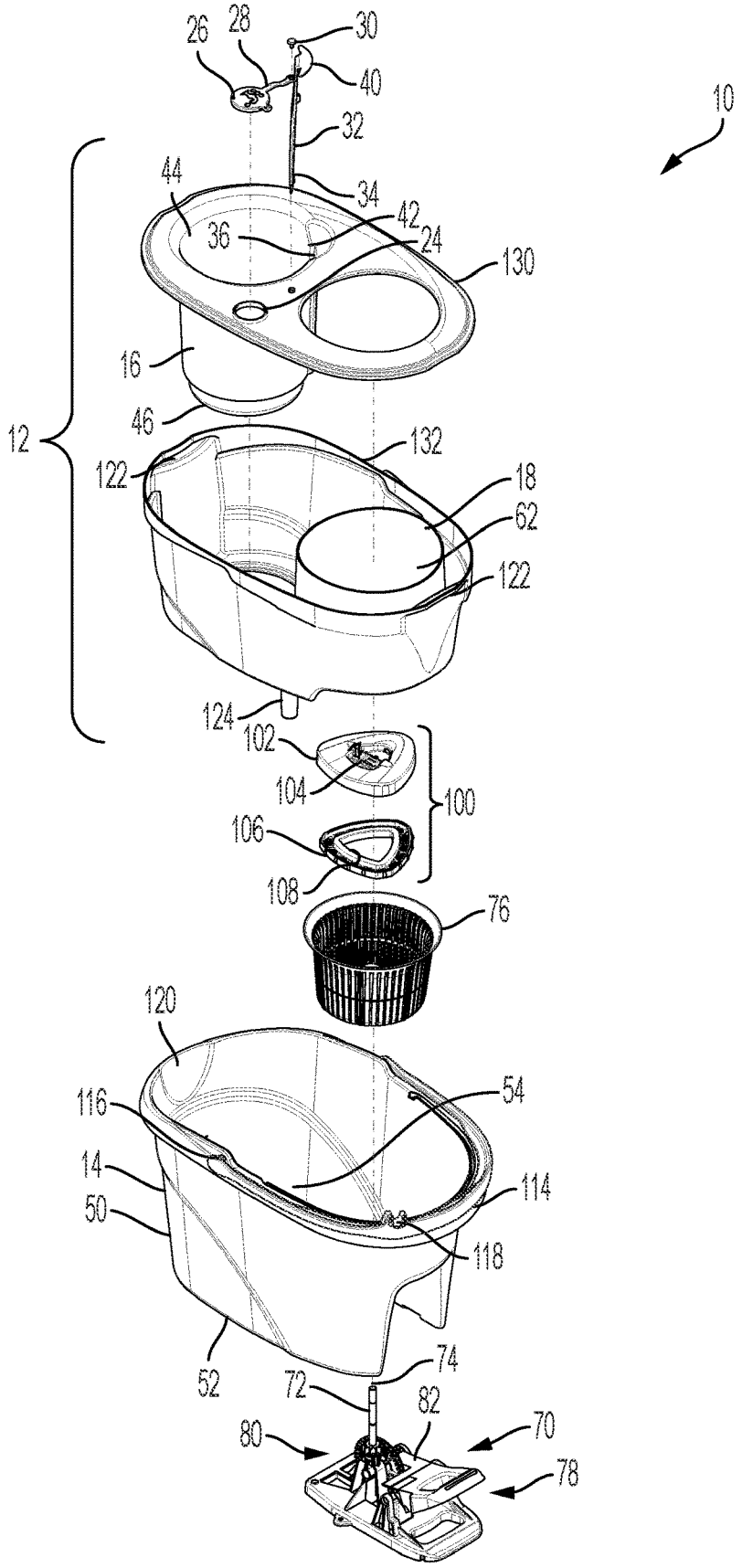
FIG. 2 is an exploded view of the bucket assembly and exemplary fragmentary mop head of FIG. 1.

In order to facilitate transport of the bucket assembly 10, a handle 114 may be provided (see FIGS. 1 and 2). The illustrated handle 114 may be attached at pivot points 116 at either side of the bucket assembly 10, here, at either side of the outer bucket assembly 14. In at least one embodiment, the handle 114 includes a clip 118 for releasably receiving the shaft or rod (not illustrated) of a mop. It will be appreciated that the clip may have any appropriate structure. Referring to FIG. 8, the clip 118 may include a cradle 172 for removably receiving a shaft of a mop, fingers 174 being disposed about the shaft. The clip 118 may include a cavity 176 that provides an additional level of flexibility to the cradle 172 and fingers 174 of the clip 118. In this way, the clip may be utilized with various diameters of a shaft of a mop.

It will further be appreciated that the inner bucket assembly 12 may be separable from the outer bucket assembly 14 in order to facilitate filling of the first reservoir 20, and emptying of the second reservoir 54. To facilitate emptying of the second reservoir 54, the outer bucket assembly 14 may include a pour spout 120. The pour spout 120 may be spaced from the inner bucket assembly 12 when the inner and outer bucket assemblies 12, 14 are assembled together such that the second reservoir 54 may be readily emptied whether or not the components are assembled together.

To facilitate handling of the inner bucket assembly 12 when it is separated from the outer bucket assembly 14, the inner bucket assembly 12 may include flanges 122 on either side of the inner bucket assembly 12 that allow an operator to readily grasp the inner bucket assembly 12 for separation from the outer bucket assembly 14 or carrying for filling. The inner bucket assembly 12 may additionally include one or more legs 124, 126 that along with the rinse bucket base 46, may be used to stabilize the inner bucket assembly 12 on a surface. The legs 124, 126 may additionally engage structure of the outer bucket assembly 14 in some embodiments.

The inner and outer bucket assemblies 12, 14 may be fabricated from any suitable material and by any suitable method. For example, the assemblies 12, 14 may be formed from a polymeric material, with or without fillers, and may be molded, such as by injection or blow molding. By way of further example, the assemblies 12, 14 may be 3D printed.

Further, the inner and outer bucket assemblies 12, 14 may be formed of single or multiple pieces and then assembled by an appropriate method. For example, the inner bucket assembly may include a first inner bucket element 130 and a second inner bucket element 132. In this way, the first reservoir 20 may be formed of the first inner bucket element 130, the second inner bucket element 132, or a combination of the first and second inner bucket elements 130, 132. In the illustrated embodiment, the first inner bucket element 130 includes the rinse bucket 16, while the second inner bucket element 132 includes at least a portion of the drainage channel 18, the first reservoir 20 being formed between the first and second inner bucket elements 130, 132, although varied structures are envisioned under this disclosure. As may be seen in FIG. 2, in some embodiments, at least a portion of the first inner bucket element 130, here, the rinse bucket 16, may be received within and/or through the second inner bucket element 132.

One or more welds or other appropriate sealing mechanisms may be provided between the first and second inner bucket elements 130, 132 in order to provide a sealed first reservoir 20. For example, a first weld 134 may be provided circumferentially about the rinse bucket 16, a second weld 136 may be provided circumferentially about the drainage channel 18 and a third weld 138 may be provided about the peripheries of both the first and second inner bucket elements 130, 132.

Industrial Applicability

The present disclosure is applicable to a mop bucket assembly 10 that may enhance cleaning of surfaces, by providing a ready supply of rinse fluid and facilitate efficient mopping of surfaces. By maintaining the closure element 32 in an open position, a continual supply of rinse fluid may be provided to the rinse bucket 16. Inasmuch as the first reservoir 20 may be otherwise sealed, the level of rinse fluid within the rinse bucket 16 will rise only to the level of the fluid connection 22 between the first reservoir 20 and the rinse bucket 16.

At least some embodiment of the mop bucket assembly 10 may be readily and economically fabricated and yield a reliable and durable mop bucket assembly 10.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B")

is to be construed to mean one item selected from the listed items (A or B) or any combination of two or more of the listed items (A and B), unless otherwise indicated herein or clearly contradicted by context.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A bucket assembly for use with a mop having a mop head, the bucket assembly comprising:

an inner bucket assembly, the inner bucket assembly including a rinse bucket, a first reservoir, a fluid connection between the rinse bucket and the first reservoir, and at least one closure element disposed at the fluid connection and selectively movable between an open position and a closed position, the inner rinse bucket including an elongated recess, and the at least one closure element including an elongated structure that is slidably received in the elongated recess to selectively open and close the fluid connection between the first reservoir and the rinse bucket, the open position defining an opening created between the rinse bucket and the first reservoir, an outer bucket assembly, the outer bucket assembly including an outer bucket peripheral wall extending from an outer bucket base to form a second reservoir, the inner bucket assembly being disposed at least partially within the outer bucket assembly, a drainage channel fluidly connected to the second reservoir, the drainage channel being formed by at least one of the inner bucket assembly, the outer bucket assembly, and the inner bucket assembly and the outer bucket assembly, and wherein the first reservoir is optionally otherwise sealed when the at least one closure element is in the open position whereby fluid disposed within the first reservoir may freely be transferred to the rinse bucket as air from the rinse bucket enters the first reservoir through the opening, air entering the first reservoir and fluid flowing from the first reservoir to the rinse bucket only until a level of fluid in the rinse bucket covers the opening created by the at least one closure element sliding to the open position.

2. The bucket assembly of claim 1 wherein disposition of the closure element at the fluid connection determines a level of rinse fluid in the inner bucket when the at least one closure element is maintained in the open position and the first reservoir is otherwise sealed.

3. The bucket assembly of claim 1 wherein the inner bucket assembly includes a first inner bucket element and a second inner bucket element, the first inner bucket element forming the rinse bucket, the first reservoir being formed by at least one of the first inner bucket element, the second inner bucket element, and the first inner bucket element and the second inner bucket element.

4. The bucket assembly of claim 3 wherein the first inner bucket element is at least partially received within the second inner bucket element, the first reservoir being formed between the first inner bucket element and the second inner bucket element.

5. The bucket assembly of claim 3 further including at least one weld between the first inner bucket element and the second inner bucket element.

6. The bucket assembly of claim 5 wherein the inner bucket assembly includes at least a portion of the drainage channel, and wherein the at least one weld includes a first weld circumferentially about the rinse bucket, and a second weld circumferentially about the drainage channel.

7. The bucket assembly of claim 6 wherein the at least one weld further includes a third weld about peripheries of both the first inner bucket element and the second inner bucket element.

8. The bucket assembly of claim 3 wherein the second inner bucket element includes a cylindrical portion forming the drainage channel, the cylindrical portion being spaced from the outer bucket assembly base.

9. The bucket assembly of claim 3 wherein the second inner bucket element includes at least one downwardly-extending leg extending from the second inner bucket element to the outer bucket assembly, the downwardly-extending leg being configured to partially support the second inner bucket element within the outer bucket assembly.

10. The bucket assembly of claim 1 wherein the inner bucket assembly is separable from the outer bucket assembly, and the inner bucket assembly includes at least one inner bucket assembly handle.

11. The bucket assembly of claim 1 wherein the inner bucket assembly further includes a fill opening into the first reservoir and a plug sized to selectively seal the fill opening.

12. The bucket assembly of claim 1 wherein the inner bucket assembly is separable from the outer bucket assembly, and the inner bucket assembly includes at least one downwardly-extending leg, the at least one downwardly-extending leg and the rinse bucket being disposed to support the inner bucket assembly on a surface when separated from the outer bucket assembly.

13. The bucket assembly of claim 1 wherein the rinse bucket includes a rinse bucket peripheral wall extending from a rinse bucket base, the rinse bucket base including at least one protrusion extending into an interior of the rinse bucket.

14. The bucket assembly of claim 1 wherein the outer bucket assembly includes a selectively actuable rotating element including a central spin axis, the central spin axis being disposed such that it extends into the drainage channel.

15. The bucket assembly of claim 14 further including a foot pedal, and a gear assembly, the gear assembly being operably disposed between the foot pedal and the rotating element to selectively rotate the rotating element.

16. The bucket assembly of claim 15 further including a basket disposed within the drainage channel, the basket being coupled to the actuable rotating element.

17. The bucket assembly of claim 1 wherein the outer bucket assembly includes at least one handle, the at least one handle being offset from a central line of the outer bucket assembly.

18. The bucket assembly of claim 1 including a handle pivotably coupled to the outer bucket assembly, the handle including a clip configured to receive an elongated rod.

19. A method of operating the bucket assembly of claim 1, the method comprising:

supplying rinse solution to the first reservoir;

manually moving the closure element from the closed position to the open position, while maintaining the first reservoir in an otherwise sealed condition.

20. A bucket assembly for use with a mop having a mop head, the bucket assembly comprising:

an inner bucket assembly, the inner bucket assembly including a rinse bucket, a first reservoir, a fluid connection between the rinse bucket and the first reservoir, and at least one closure element disposed at the fluid connection and movable between an open position and a closed position, the inner bucket assembly includes a first inner bucket element and a second inner bucket element, the first inner bucket element forming the rinse bucket, the first reservoir being formed between the first inner bucket element and the second inner bucket element an outer bucket assembly, the outer bucket assembly including an outer bucket peripheral wall extending from an outer bucket base to form a second reservoir, the inner bucket being disposed at least partially within the second reservoir, a drainage channel fluidly connected to the second reservoir, the drainage channel being at least partially formed by the inner bucket assembly, a basket disposed within the drainage channel, and a plurality of welds between the first inner bucket element and the second inner bucket element, said plurality of welds including a first weld between the first circumferentially about the rinse bucket, a second weld circumferentially about the drainage channel, and a third weld about peripheries of both the first inner bucket element and the second inner bucket element, the outer bucket assembly further including a selectively actuable rotating element including a central spin axis, the central spin axis being disposed such that it extends into the drainage channel, a foot pedal, and a gear assembly, the gear assembly being operably disposed between the foot pedal and the rotating element to selectively rotate the rotating element, the basket being coupled to the actuable rotating element wherein the inner rinse bucket includes an elongated recess, and the at least one closure element includes an elongated structure that is slidably received in the elongated recess to selectively open and close the fluid connection between the first reservoir and the rinse bucket, the open position defining an opening created between the rinse bucket and the first reservoir.

21. The bucket assembly of claim 20 wherein the central spin axis is substantially vertical.

* * * * *